US009724585B2

(12) United States Patent
Peterson

(10) Patent No.: US 9,724,585 B2
(45) Date of Patent: Aug. 8, 2017

(54) BASKETBALL SHOT TRAINING SYSTEM AND METHOD

(71) Applicant: ShotTek LLC, Kirkland, WA (US)

(72) Inventor: Larry Peterson, Kirkland, WA (US)

( * ) Notice: Subject to any disclaimer, the term of this patent is extended or adjusted under 35 U.S.C. 154(b) by 0 days.

(21) Appl. No.: 15/197,660

(22) Filed: Jun. 29, 2016

(65) Prior Publication Data

US 2016/0310813 A1 Oct. 27, 2016

Related U.S. Application Data

(63) Continuation-in-part of application No. 13/961,773, filed on Aug. 7, 2013, now Pat. No. 9,415,288.

(60) Provisional application No. 62/186,211, filed on Jun. 29, 2015, provisional application No. 61/704,976, filed on Sep. 24, 2012, provisional application No. 61/681,548, filed on Aug. 9, 2012.

(51) Int. Cl.
*A63B 69/00* (2006.01)

(52) U.S. Cl.
CPC ..... *A63B 69/0071* (2013.01); *A63B 69/0059* (2013.01); *A63B 2220/40* (2013.01)

(58) Field of Classification Search
CPC ..... A61F 5/05875
USPC ..... 473/450, 449, 447, 422, 458, 464
See application file for complete search history.

(56) References Cited

U.S. PATENT DOCUMENTS 8,702,540 B2 * 4/2014 Menchio ..... A63B 71/14 473/22
2009/0318248 A1 * 12/2009 Russotti ..... A63B 69/0071 473/450

* cited by examiner

*Primary Examiner* — Aarti B Berdichevsky
*Assistant Examiner* — Rayshun Peng
(74) *Attorney, Agent, or Firm* — Orrick, Herrington & Sutcliffe, LLP

(57) ABSTRACT

Systems and methods for basketball shot training and an apparatus therefore are disclosed. In one embodiment, the providing a basketball shot training apparatus includes a first arm extending from a web, a second arm extending from the web, a cavity defined by the first and second arm and the web, a first-arm band disposed on and surrounding a portion of the first arm, and a second-arm band disposed on and surrounding a portion of the second arm.

13 Claims, 9 Drawing Sheets

BASKETBALL SHOT TRAINING SYSTEM AND METHOD

CROSS REFERENCE TO RELATED APPLICATIONS

This application claims the benefit of U.S. Provisional Application No. 62/186,211, filed Jul. 29, 2015, and is a continuation-in-part of U.S. patent application Ser. No. 13/961,773, filed Aug. 7, 2013, which claims priority to U.S. Provisional Application No. 61/704,976, filed Sep. 24, 2012 and U.S. Provisional Application No. 61/681,548, filed Aug. 9, 2012, and which all above-mentioned applications are hereby incorporated herein by reference in their entirety and for all purposes.

BACKGROUND

In the game of basketball, players throw the ball at the basket with the aim of having the ball pass through the hoop to score points. A player making accurate shots is important because a team may therefore score more points and may be more likely to win a game. Making accurate shots in basketball requires consistent use of correct technique, and learning to use consistent accurate technique may increase a player's value by increasing the player's ability to score points.

Practicing proper shooting technique can improve a player's consistency and accuracy. Although it is possible to practice without the aid of training products, the use of a training product can substantially enhance the efficacy of practice by forcing or promoting proper form. Various devices exist which assist basketball players in practicing, however many of these devices are cumbersome, expensive, and can interfere with natural proper form. Accordingly, there remains a need in the art for basketball shot training products that allow a player to train correct form and that are not cumbersome or expensive and that do not interfere with natural correct form.

DETAILED DESCRIPTION

Figure 1:
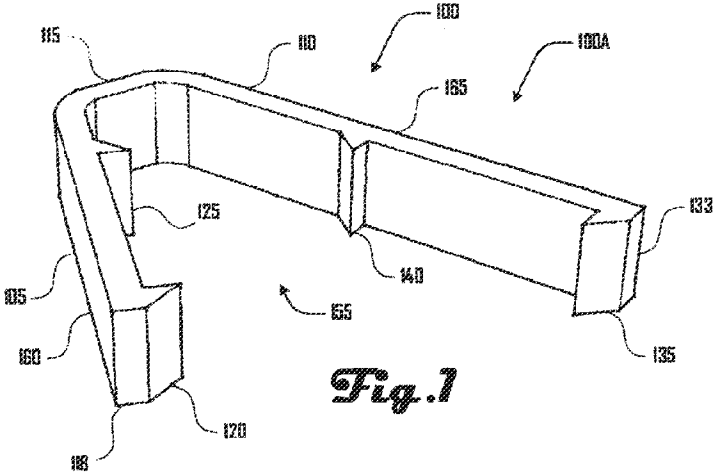
FIG. 1 depicts a perspective view of a basketball shot training apparatus in accordance with an embodiment.
Figure 2A:
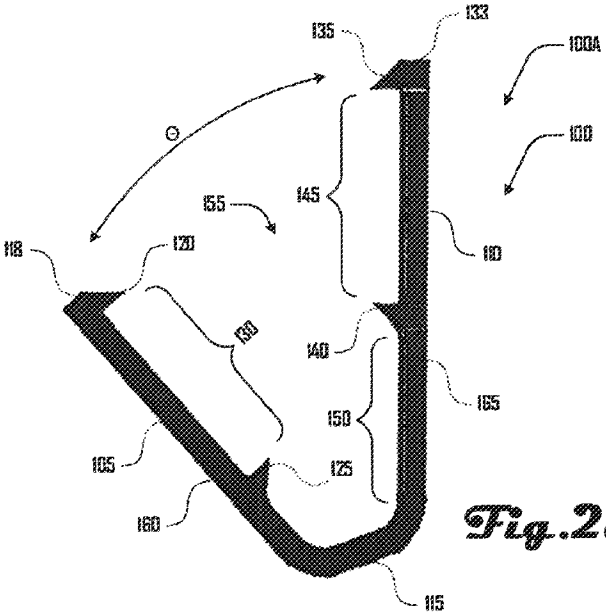
FIG. 2*a* depicts a side view of the basketball shot training apparatus in accordance with the embodiment depicted in FIG. 1.

FIGS. 1 and 2*a* depict a basketball shot training apparatus 100 in accordance with an embodiment 100A. The apparatus 100A comprises an elongated index-finger arm 105 and an elongated middle-finger arm 110, which extend from and are integrally connected via a web 115. The arms 105, 110 are positioned relative to each other at an angle Θ. The arms 105, 110 and web 115 define a V-shaped cavity 155.

Proximate to an index-finger arm end 118 of index-finger arm 105 an index-finger-arm-end ridge 120 extends into the cavity 155. An index-finger-arm-internal ridge 125 extends into the cavity 155 at a position separate from the index-finger-arm-end ridge 120 and closer to the web 115. The ridges 120, 125 and a portion of the index-finger arm 105 define an index-finger coupling slot 130.

Proximate to a middle-finger arm end 133 of middle-finger arm 110 a middle-finger-arm-end ridge 135 extends into the cavity 155. A middle-finger-arm-internal ridge 140 extends into the cavity 155 at a position separate from the middle-finger-arm-end ridge 135 and closer to the web 115. The ridges 135, 140 and a portion of the middle-finger arm 110 define an upper middle-finger coupling slot 145. The middle-finger-arm-internal ridge 140, a portion of the middle-finger arm 110, and a portion of the web 115 define a lower middle-finger coupling slot 150.

In an embodiment, the ridges 120, 125, 135, 140 may be triangular with points that extend inwardly within the cavity 155. The end ridges 120, 135 may be sloped toward the ends 118, 133 and the index-finger coupling slot 130 and upper middle-finger coupling slot 145 may be defined by portions of the ridges 120, 125, 135, 140 that are flat and extend perpendicularly to their respective arm 105, 110. The internal ridges 125, 140 may slope toward the web 115.

While various embodiments depicted herein include triangular ridges 120, 125, 135, 140, in some embodiments the ridges 120, 125, 135, 140 may be any suitable shape, size or orientation. For example, ridges 120, 125, 135, 140 may be rectangular, rounded or the like. Additionally, in some embodiments, there may be any suitable number of ridges in various suitable locations on the arms 105, 110, and in some embodiments there may be no ridges.

Figure 2B:
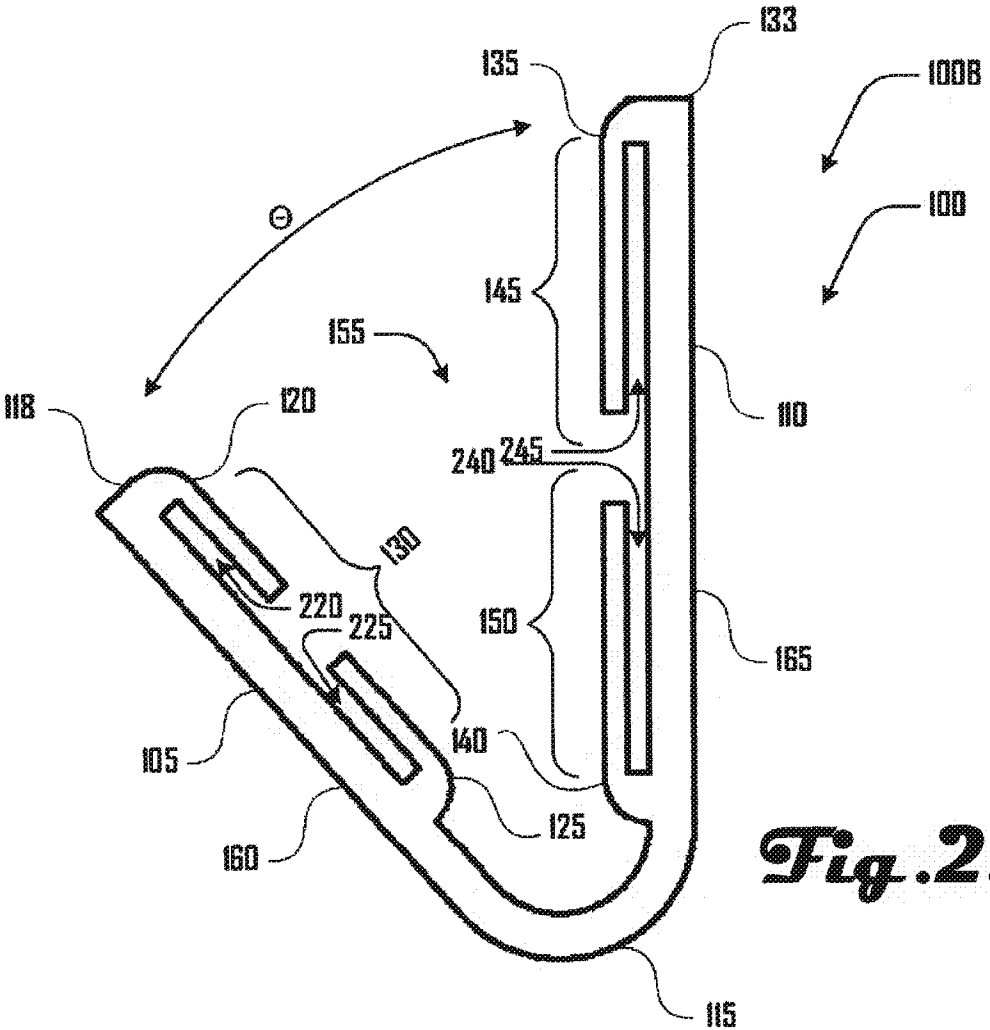
FIG. 2*b* depicts a side view of a basketball shot training apparatus in accordance with another embodiment.

For example, FIG. 2*b* depicts a side view of a basketball shot training apparatus 100 having ridges 120, 125, 135, 140 in accordance with another embodiment 100B. In this embodiment of the apparatus 100B, index-finger-arm-end ridge 120 extends into the cavity 155 and further extends toward the web 115 parallel to the index-finger arm 105 and defining an index-finger-arm-end ridge slot 220.

The index-finger-arm-internal ridge 125 extends into the cavity 155 at a position separate from the index-finger-arm-end ridge 120 and closer to the web 115. The index-finger-arm-internal ridge 125 further extends toward the index-finger-arm end 118 parallel to the index-finger arm 105 and defining an index-finger-arm-internal ridge slot 225. The ridges 120, 125 and a portion of the index-finger arm 105 define an index-finger coupling slot 130.

Proximate to the middle-finger arm end 133 of middle-finger arm 110, the middle-finger-arm-end ridge 135 extends into the cavity 155 and further extends toward the web 115 parallel to the middle-finger arm 110 and defining a middle-finger-arm-end ridge slot 245. The middle-finger-arm-internal ridge 140 extends into the cavity 155 at a position separate from the middle-finger-arm-end ridge 135 and closer to the web 115. The middle-finger-arm-internal ridge 140 further extends toward the middle-finger-arm end 133 parallel to the middle-finger arm 110 and defining an index-finger-arm-internal ridge slot 240. The ridge 135 and a portion of the middle-finger arm 110 define an upper middle-finger coupling slot 145. The middle-finger-arm-internal ridge 140 and a portion of the middle-finger arm 110 defines a lower middle-finger coupling slot 150.

In an embodiment, the apparatus 100 may be substantially planar, with the arms 105, 110 having substantially flat opposing faces which reside within substantially the same plane. The arms 105, 110 and web 115 may be various suitable sizes, and in various embodiments may be configured to correspond to a portion of a human hand. For example in various embodiments one arm 105 or 110 may be substantially longer than the other to accommodate different lengths of fingers.

Figure 3:
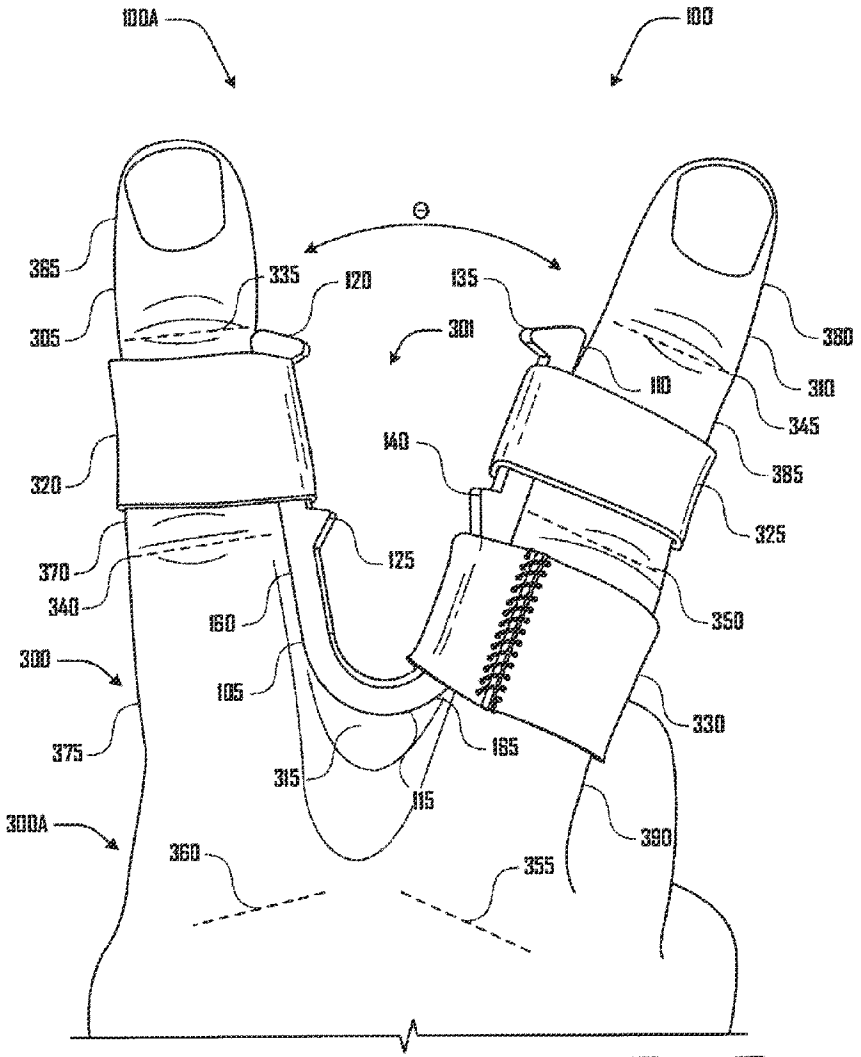
FIG. 3 depicts the basketball shot training apparatus of FIGS. 1 and 2 being worn on a right hand in accordance with an embodiment.

FIG. 3 depicts the basketball shot training apparatus 100A being worn on a right hand 300 in accordance with an embodiment. The apparatus 100A is positioned between the index finger 305 and middle finger 310 of the hand 300, and resting on the saddle 315 between the fingers 305, 310 and within the slot 301 between the fingers.

The apparatus 100A is coupled to the index finger 305 via an upper-index-finger band 320, which surrounds the index finger 305 and resides within the index-finger coupling slot 130 (FIGS. 1 & 2). The apparatus 100A is coupled to the middle finger via an upper-middle-finger band 325 and a lower-middle-finger band 330, which surround the middle finger 310 and reside within the upper middle-finger coupling slot 145 and lower middle-finger coupling slot 150 (FIGS. 1 & 2*a*), respectively.

In various embodiments, the apparatus 100A may be configured to correspond to the index and middle fingers 305, 310 of a human hand 300. For example, the index finger 305 comprises a distal index interphalangeal joint 335, a proximal index interphalangeal joint 340, and an index metacarpophalangeal joint 360, which respectively define distal, middle and proximal index finger portions 365, 370, 375. The index finger arm 105, web 115, and ridges 120, 125 may be configured such that the index-finger coupling slot 130 is aligned with the middle index finger portion 370. In an embodiment, as shown in FIG. 3, the index-finger-arm-internal ridge 125 may be aligned with the proximal index interphalangeal joint 340. The index-finger-arm-end ridge 120 may be aligned below the distal index interphalangeal joint 335.

Such a configuration may be desirable in various embodiments because it may allow the upper-index-finger band 320 to surround the index finger portion 370 without substantially obstructing or impeding the distal index interphalangeal joint 335 and proximal index interphalangeal joint 340, which may allow for enhanced comfort and range of motion as the apparatus 100A is worn and used.

Similarly, the middle finger 310 comprises a distal middle-finger interphalangeal joint 345, a proximal middle-finger interphalangeal joint 350, and a middle-finger metacarpophalangeal joint 355, which respectively define distal, middle and proximal middle finger portions 380, 385, 390. The middle finger arm 110, web 115, and ridges 135, 140 may be configured such that the upper middle-finger coupling slot 145 is aligned with the middle-middle-finger portion 385. In an embodiment, as shown in FIG. 3, the middle-finger-arm-internal ridge 140 may be aligned with the proximal middle finger interphalangeal joint 350. The middle-finger-arm-end ridge 135 may be aligned below the distal middle interphalangeal joint 345.

Such a configuration may be desirable in various embodiments because it may allow the upper-middle-finger band 325 to surround the middle-middle-finger portion 385 without substantially obstructing or impeding the distal middle-finger interphalangeal joint 345 and proximal middle-finger interphalangeal joint 350, which may allow for enhanced comfort and range of motion as the apparatus 100A is worn and used. Additionally, such a configuration may also allow the lower-middle-finger band 330 to surround the proximal-middle-finger portion 390 without substantially obstructing or impeding the middle-finger metacarpophalangeal joint 355 and proximal middle-finger interphalangeal joint 350, which may allow for enhanced comfort and range of motion as the apparatus 100A is worn and used.

In some embodiments, the bands 320, 325, 330 may be held in other ways. For example, referring to FIG. 2*b*, bands 320, 325, 330 may be held respectively in slots 130, 145, 150 defined by the ridges 120, 125, 135, 140.

In some embodiments, there may be any suitable number of bands 320, 325, 330 used to couple the apparatus with a hand 300. For example, in an embodiment, two bands may surround the index finger 305 and index-finger arm 105.

In some embodiments, one band may surround the middle finger 310 and one band may surround the middle finger arm 110. (See, e.g., FIGS. 4*a* and 4*b*). Referring to FIG. 2*b*, for example, a first band may reside within both of the slots 220, 225 and a second band may reside within both of the slots 240, 245.

The bands 320, 325, 330 may be made of any suitable material. For example, in one embodiment, they made be made of sewn neoprene, rubber bands, Lycra bands, adhesive tape, or the like. In various embodiments, the bands 320, 325, 330 may be configured to be stretchable such that they may snugly encircle a finger 305, 310 along with an arm 105, 110 of the apparatus 100A such that the apparatus 100A is snugly held within the slot 301 between the index and middle fingers 305, 310.

In some embodiments, various other structures of any suitable material may be used to couple the apparatus 100 with the index and middle fingers 305, 310. For example, clips, adhesive, a friction fit, or the like may be present to couple the apparatus 100 with the index and middle fingers 305, 310. Additionally, such structures may interface with the apparatus in various ways. For example, such structures may be integrally connected, or may be connected via loops, adhesive, stitching, a weld or the like. In some embodiments, the bands 320, 325, 330 or other structure for coupling the apparatus 100 may be removable or non-removable from the apparatus 100.

The apparatus 100 may comprise various suitable materials, and may be rigid or flexible. For example, the apparatus may comprise plastic, rubber, acrylic, wood, polyvinyl chlorate ("PVC"), metal or the like. In some embodiments it may be desirable for the apparatus 100 to flex about the web 115 allowing the arms 105, 110 to move toward each other. Providing for some dynamic flexing in the apparatus 100 may improve comfort and use in some embodiments. In some embodiments, it may be desirable to select a material that is substantially rigid that provides little if any dynamic flexing.

The apparatus 100 may be configured to conform to the index and middle fingers 305, 310 in some embodiments. For example, in some embodiments, the outer portions 160, 165 of the arms 105, 110 may be concave to correspond to the curvature of the index and middle fingers 305, 310. Additionally, in some embodiments, the web 115 may also be concave to correspond to the curvature of the saddle 315 between the index and middle fingers 305, 310.

In various embodiments, the apparatus 100 may have an angle Θ between the arms 105, 110 that allows the index and middle fingers 305, 310 to substantially maintain an optimal angle for proper shooting technique. In one embodiment, this angle Θ may be 42°. In some embodiments, the angle Θ may be 39°, 40°, 41°, 42°, 43°, 44°, 45° or other desirable angle.

The width of the apparatus 100 may be configured to prevent contact with the ball, and may be configured to be less than the width of the index and middle fingers 305, 310.

The apparatus 100 may be proportionally configured to correspond to a hand 300 of various sizes. For example, children and adults have varying sizes and proportions of hands, and the apparatus 100 may be configured for different sizes and configurations of hands. Additionally the apparatus 100 may be configured for use on a right or left hand.

Figure 4A:
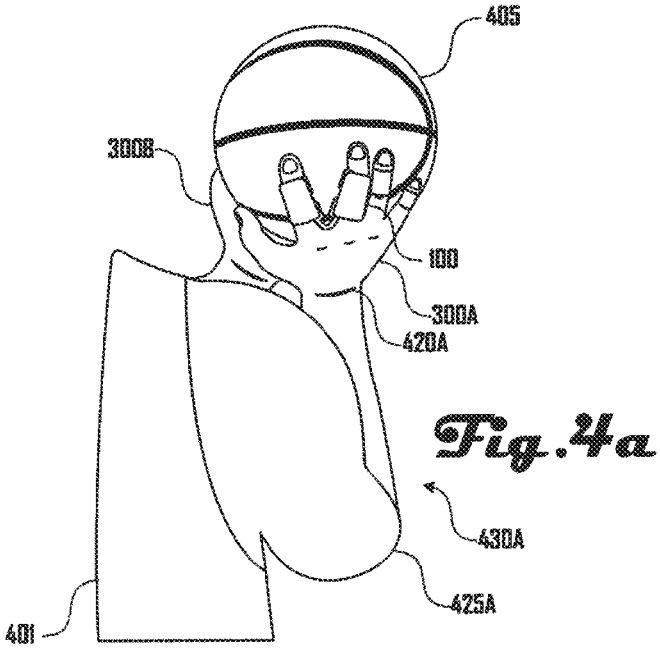
FIG. 4*a* depicts using a basketball shot training apparatus in accordance with an embodiment.
Figure 4B:
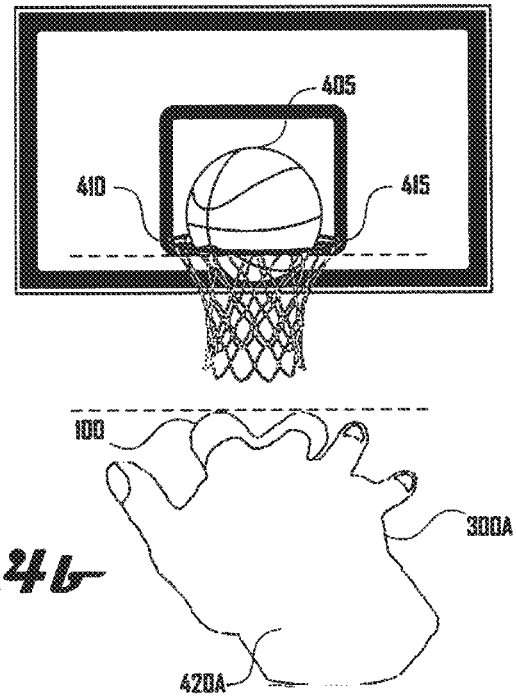
FIG. 4*b* depicts using a basketball shot training apparatus in accordance with an embodiment.

The apparatus 100 may be used for basketball shot training while coupled to a hand 300 as depicted in FIGS. 3, 4*a* and 4*b*. For example, when making a shot in basketball, (i.e., throwing a basketball 405 toward the basket in an effort to make the basketball 405 pass through the hoop/basket 410) good form includes holding the ball 405 with a shooting hand 300A and a balance hand 300B, with the shooting hand palm pointed toward the basket 410 and the balance hand 300B providing balance to the ball 405 as it rests in the shooting hand 300A. When holding the ball 405 in preparation for a shot, space should remain between the ball 405 and shooting hand palm, with the fingers of the shooting hand 300A spread to provide a comfortable balance as the ball sits on the finger pads (See e.g., FIG. 4*a*).

When a shot is executed, the wrist 420A of the shooting hand 300A flicks the ball 405 toward the basket. The shooting hand 300A should extend in a straight line toward the rim 415 of the basket 410 and the ball 405 should come off the shooting hand 300A with symmetrical backspin (i.e., spinning backwards toward the shooter about a horizontal axis). The wrist 420A should be relaxed and floppy with the index and middle fingers 305, 310 of the shooting hand 300A ending up parallel to the rim 415 of the basket 410 and pointing at the rim 415 (See, e.g., FIG. 4*b*).

The apparatus 100 may be configured to allow a user to practice this proper technique by positioning the user's shooting hand 300A index and middle fingers 305, 310 at a correct angle, and forcing the user to maintain a V-shape with the index and middle fingers 305, 310 so that the user can focus on and confirm that his shooting hand index and middle fingers 305, 310 of the shooting hand 300A end up parallel to the rim 415 of the basket 410 and are pointing at the rim 415 (See, e.g., FIG. 4*b*). Additionally, the apparatus 100 may be configured to not interfere with or contact the ball 405 while the user is practicing shooting technique with the apparatus 100.

Figure 5:
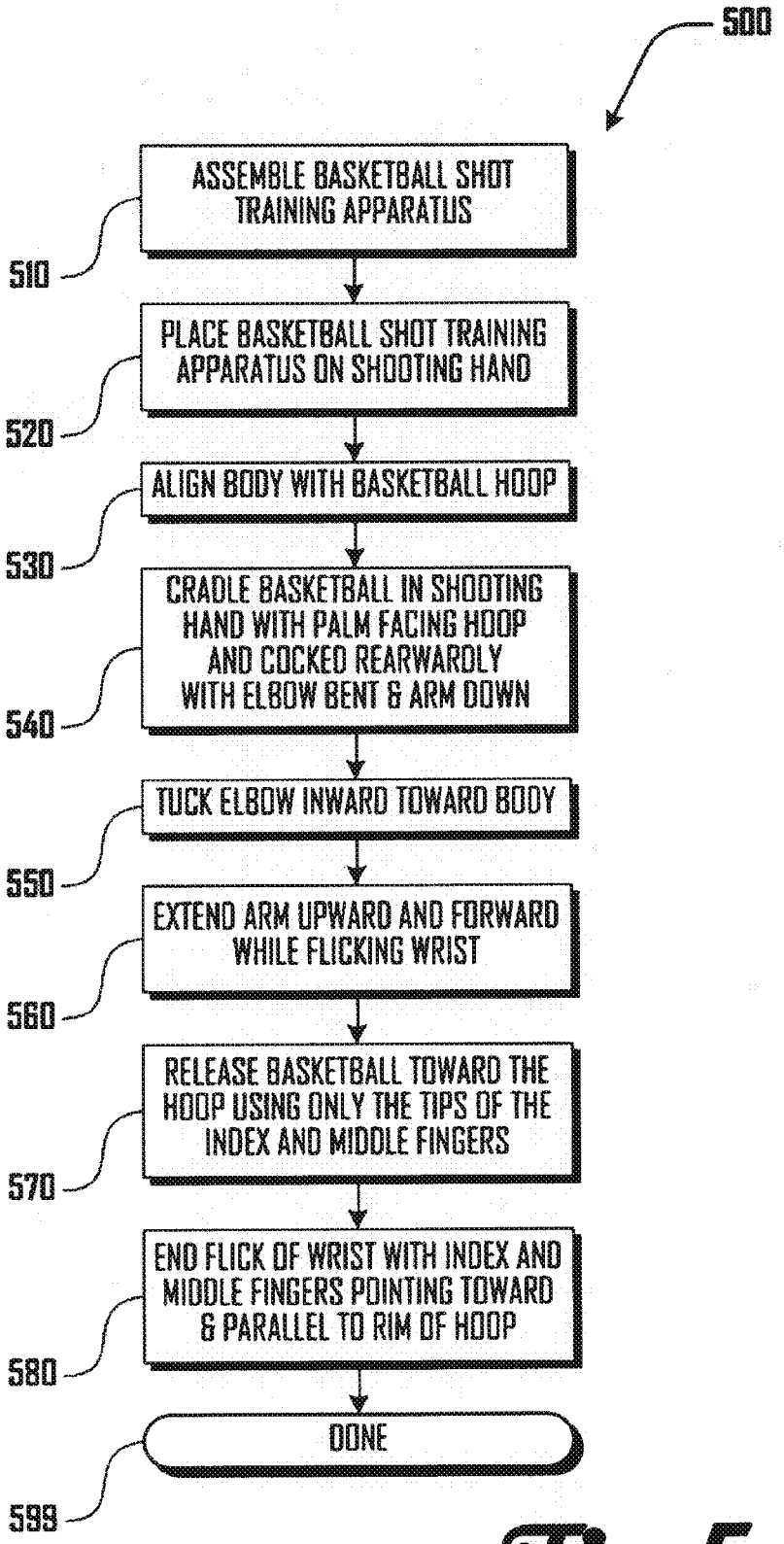
FIG. 5 depicts a method of using a basketball shot training apparatus in accordance with an embodiment.

FIG. 5 depicts a flow chart of a method 500 of using a basketball shot training apparatus 100 in accordance with an embodiment. The method 500 begins in block 510, where the basketball shot training apparatus 100 is assembled. For example, referring to FIG. 2*b*. Assembling the basketball shot training apparatus 100 may include inserting a first elastic band into the slots 220, 225 and surrounding a portion of the index-finger arm 105. Assembling the basketball shot training apparatus 100 may also including inserting a second elastic band into slots 240, 245 and surrounding a portion of the middle-finger arm 110. One example of a basketball shot training apparatus having a first and second elastic band is shown in FIGS. 4*a* and 4*b*.

Returning to the method 500, in block 520, the basketball shot training apparatus 100 is placed on the shooting hand of a user (either left or right hand). For example, in an embodiment having a first and second elastic band as shown in FIGS. 4*a* and 4*b* for example, the elastic bands are positioned respectively surrounding a portion of the middle and index fingers, with the arms 105, 110 (FIG. 2*b*) respectively extending along and adjoining a portion of the middle and index fingers. The web 115 may be positioned adjoining the saddle between the index finger and middle finger. FIG. 3 depicts an alternative embodiment having three bands.

Returning again to the method 500, in block 530, the shooter aligns his body with the basketball hoop 410 (FIG. 4*b*), and in block 540, the shooter cradles a basketball 405 in his shooting hand 300A with his palm facing the hoop 410 and with his shooting hand 300A cocked rearwardly with his shooting elbow 425 bent and his shooting arm 430A down. In various embodiments, the shooting hand should be placed on the ball with the index finger pointing straight up (this causes the middle finger to become the same size as the index, from tip to wrist) thus giving the shooter an even, two-point, fixed platform to shoot the ball off of evenly. In block 550, the shooter tucks his elbow 425A inward toward his body 401. FIG. 4*a* depicts an example of a shooter in the position generated by the steps of blocks 540 and 550.

In block 560, the shooter extends his shooting arm 430A upward and forward while flicking his wrist 420A, and in block 570, the shooter releases the ball 405 toward the basket with only the tips of the index and middle fingers. In block 580, the shooter ends the flick of the wrist 420A with his index and middle fingers pointing toward and parallel to the rim 415 of the hoop 410. One example of such a finishing position is depicted in FIG. 4*b*. The method 500 is done in block 599.

Figure 6A:
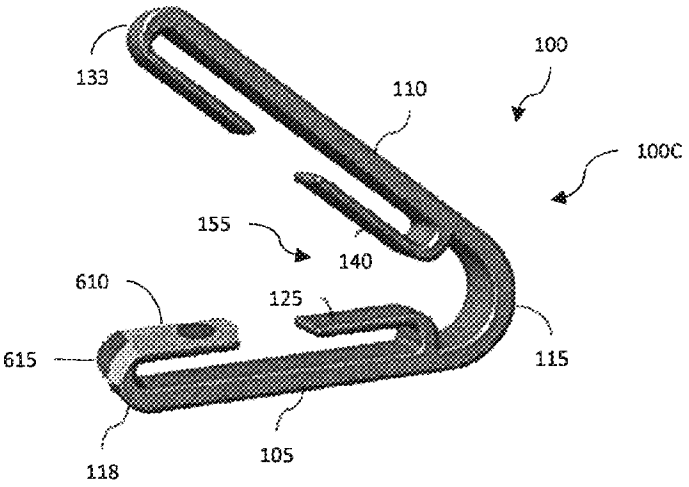
FIG. 6*a* depicts a side view of a basketball shot training apparatus having an accelerometer in accordance with another embodiment.
Figure 6B:
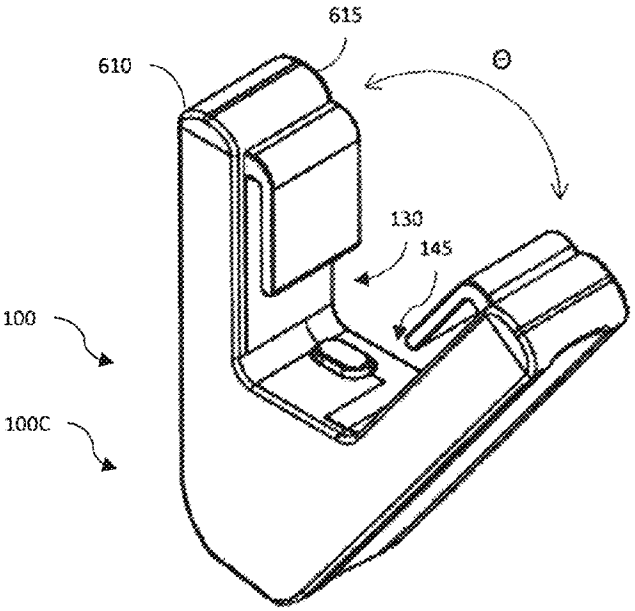
FIG. 6*b* depicts a perspective view of the basketball shot training apparatus in accordance with the embodiment depicted in FIG. 6*a*.

In yet another embodiment, FIGS. 6*a* and 6*b* depict the basketball shot training apparatus 100 in accordance with an embodiment 100C. The apparatus 100C comprises the elongated index-finger arm 105 and the elongated middle-finger arm 110, which extend from and are integrally connected via the web 115. The arms 105, 110 are positioned relative to each other at the angle Θ. The arms 105, 110 and web 115 define a V-shaped cavity 155.

Remote from the index-finger arm end 118 of the index-finger arm 105 the index-finger-arm-internal ridge 125 extends into the cavity 155 at a position closer to the web 115. The ridge 125 and a portion of the index-finger arm 105 define the index-finger coupling slot 130.

Remote from the middle-finger arm end 133 of the middle-finger arm 110 the middle-finger-arm-internal ridge 140 extends into the cavity 155 at a position closer to the web 115. The ridge 140 and a portion of the middle-finger arm 110 define an upper middle-finger coupling slot 145.

In various embodiments, the apparatus 100C may be configured to correspond to the index and middle fingers 305, 310 of a human hand 300 (shown in FIG. 3). For example, the index finger 305 comprises a distal index interphalangeal joint 335, a proximal index interphalangeal joint 340, and an index metacarpophalangeal joint 360, which respectively define distal, middle and proximal index finger portions 365, 370, 375. The index finger arm 105, web 115, and ridge 125 may be configured such that the index-finger coupling slot 130 is aligned with the middle index finger portion 370. In an embodiment, as shown in FIG. 3, the index-finger-arm-internal ridge 125 may be aligned with the proximal index interphalangeal joint 340.

Returning to FIGS. 6*a* and 6*b*, in some embodiments, the apparatus 100C is shown to include an accelerometer 610 on the index-finger arm end 118. The accelerometer 610 can be equipped with a visual signal system 615, such as, for example, a light emitting diode (LED). Although not shown, the accelerometer 610 can include motion sensors to provide measurements in three-dimensions.

The accelerometer 610 can control all operation of the visual signal system 615 as desired. In some embodiments, the accelerometer 610 causes the visual signal system 615 to give a first signal (e.g., a light turning green) when the index finger 305 is pointed at a first angle (e.g., 90 degrees from horizontal or perpendicular to the ground surface). This first signal advantageously signals to the user that they are in correct position before shooting a basketball. Similarly, the visual signal system 615 can maintain the first signal (e.g., light staying green) when the index finger 305 does not fall below (or above) a predetermined threshold angle (e.g., plus or minus 10 degrees from horizontal). If the index finger 305 dose fall below (or above) the predetermined threshold angle, thereby indicating poor shooting technique, the visual signal system 615 can give a second signal (e.g., the light turning red). This similar technique can be applied in at least three axis (x, y, and z) to advantageously provide visual cues to the user.

Figure 7B:
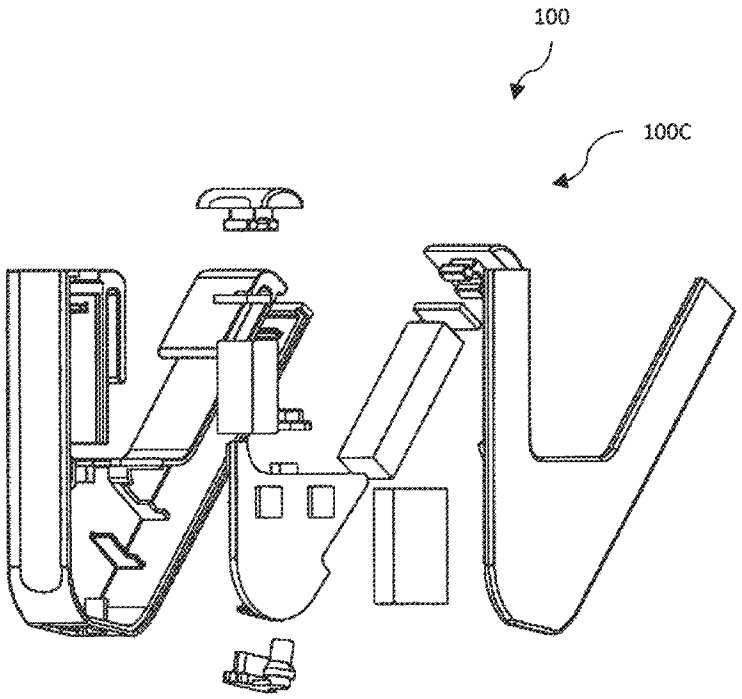
FIG. 7*b* depicts an exploded side view of the basketball shot training apparatus in accordance with the embodiment depicted in FIG. 7*a*.
Figure 7A:
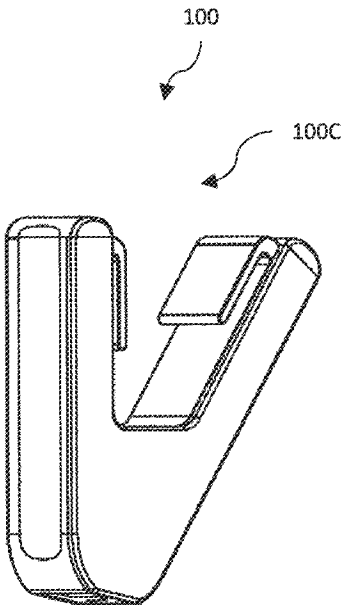
FIG. 7*a* depicts a side view of the basketball shot training apparatus in accordance with the embodiment depicted in FIG. 6*a*.

In some embodiments, the accelerometer 610 can determine when the user is not in active shooting mode. For example, if the basketball shot training apparatus 100 is pointing downward—for example, indicating that the user is dribbling the basketball—the visual signal system 615 can be shut off FIGS. 7*a* and 7*b* illustrate a side view and exploded view of the apparatus 100C.

Figure 8B:
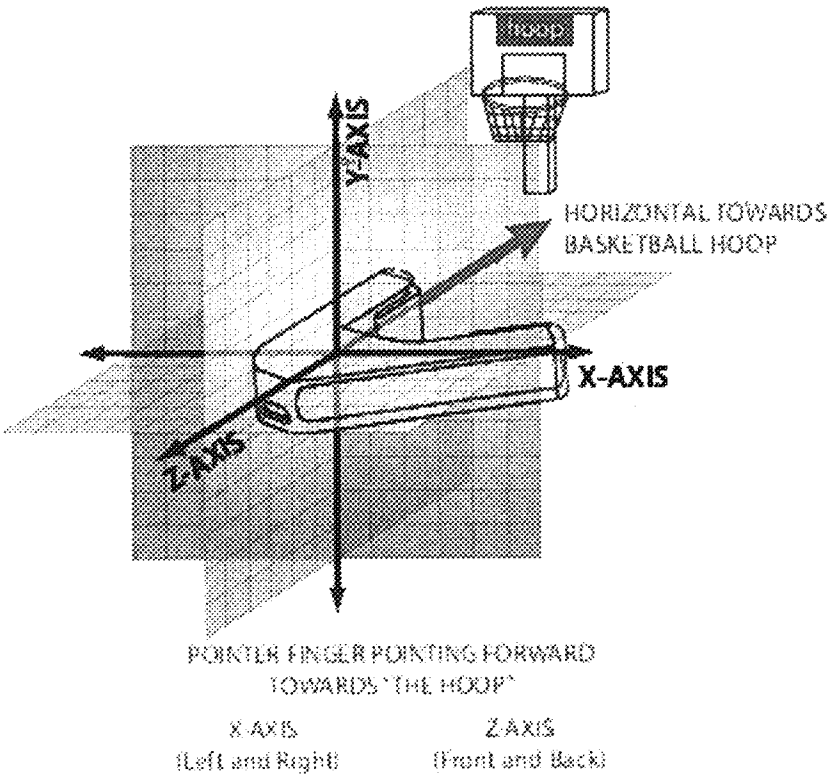
FIG. 8*b* depicts a functional view of the basketball shot training apparatus after a shot in accordance with the embodiment depicted in FIG. 6*a*.
Figure 8A:
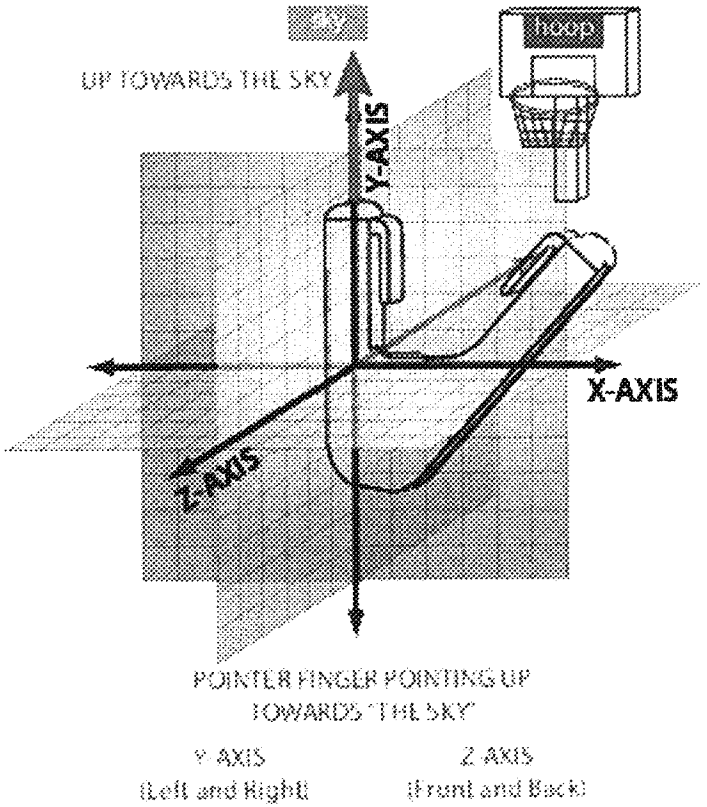
FIG. 8*a* depicts a functional view of the basketball shot training apparatus before a shot in accordance with the embodiment depicted in FIG. 6*a*.

With reference to FIGS. 8*a* and 8*b*, a sample use of the apparatus 100C is shown. In FIG. 8*a*, the apparatus 100C is shown in a first position (e.g., before the shot) such as in an upright shooting position. In the first position, the index finger 305 is pointing in an upward direction in a proper upright shooting position (within a +/−10-degree variance on the y-axis and within +/−15-degrees in the z-axis). The visual signal system 615 can show the first signal here to indicate good position. Additionally and/or alternatively, the accelerometer 610 can provide auditory and visual cues, such as flashing lights, vibrations, and so on.

If the index finger 305 is outside of the proper upright shooting position (e.g., outside of a +/−10-degree variance on the y-axis and outside of a +/−15-degree variance in the z-axis), the visual signal system 615 can indicate the second signal (e.g., red light and/or the apparatus 100C will not vibrate).

In FIG. 8*b*, following the shot, the visual signal system 615 can maintain the first signal (e.g., light staying green) when the index finger 305 does not fall below (or above) a predetermined threshold angle (e.g., plus or minus 10 degrees from horizontal). If the index finger 305 dose fall below (or above) the predetermined threshold angle, thereby indicating poor shooting technique, the visual signal system 615 can give a second signal (e.g., the light turning red). This similar technique can be applied in at least three axis (x, y, and z) to advantageously provide visual cues to the user.

Figure 9:
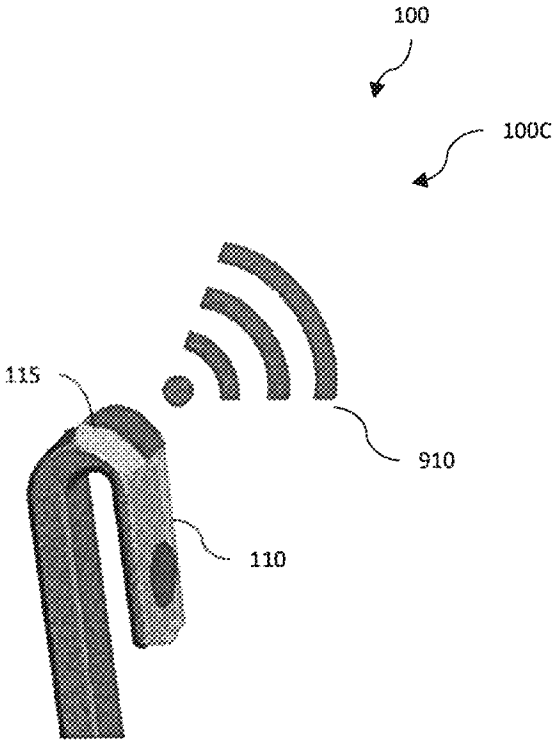
FIG. 9 depicts a side view of a basketball shot training apparatus having wireless connectivity in accordance with another embodiment.

Turning to FIG. 9, the basketball shot training apparatus 100 is also shown as including a wireless connectivity system 910. An additional sensor (not shown) can be attached, for example, to a basketball net and provide feedback data to the wireless connectivity system 910. For example, each time the basketball passes through the net and the visual signal system 615 maintained the first signal (i.e., indicating that the basket was good and the user had good form), the wireless connectivity system 910 can transmit to a separate device (not shown, for example, a user's smartphone) a first predetermined point value (e.g., a full point). Alternatively, each time the basketball passes through the next and the visual signal system 615 shows the second signal (i.e., indicating that the basket was good, but the user had poor form), the wireless connectivity system 910 can transmit to the separate device a second predetermined point value (e.g., a half point). Similarly, the second predetermined point value can be awarded if the shot is missed but the visual signal system 615 maintained the first signal (i.e., user had good form and just missed).

Accordingly, from the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated. For example, all descriptions of apparatus 100A may be applied to descriptions of apparatus 100B and vice versa. Similarly, all descriptions of apparatus 100A and/or 100B may be applied to descriptions of apparatus 100C and vice versa.

What is claimed is:

1. A basketball shot training apparatus comprising:
- a first arm extending from a web;
- a second arm extending from the web;
- a cavity defined by the first and second arm and the web;
- a first-arm band coupling slot disposed on the first arm facing the cavity;
- a second-arm band coupling slot disposed on the second arm and facing the cavity; and
- a first-arm-end ridge that extends from the first arm into the cavity and further extends toward the web substantially parallel to the first arm;
- a first-arm-end ridge slot defined by the first-arm-end ridge and a portion of the first arm;
- a first-arm-internal ridge that extends from the first arm into the cavity and further extends toward a first arm end substantially parallel to the first arm;
- a first-arm-internal ridge slot defined by the first-arm-internal ridge and a portion of the first arm;
- an accelerometer extending on a distal portion of the first arm from the cavity; and
- a visual signal system operatively coupled to the accelerometer for providing at least two signals,
- wherein the first-arm band coupling slot is at least partially defined by the first-arm-end ridge slot and the first-arm-internal ridge slot.

2. The basketball shot training apparatus of claim 1, wherein said visual signal system provides a first signal when the accelerometer detects the basketball shot training apparatus in a first position and provides a second signal when the accelerometer detects the basketball shot training apparatus in a second position.

3. The basketball shot training apparatus of claim 1, further comprising:

a first elastic band disposed within the first-arm band coupling slot and surrounding a portion of the first arm; and a second elastic band disposed within the second-arm band coupling slot and surrounding a portion of the second arm.

4. The basketball shot training apparatus of claim 3, wherein the basketball shot training apparatus is configured to be worn on a hand between the index finger and middle finger, with the web adjoining a saddle between the index finger and middle finger;

with the first arm extending along a portion of the length of the index finger;

with the second arm extending along a portion of the length of the middle finger;

with the first elastic band surrounding a portion of the index finger; and with the second elastic band surrounding a portion of the middle finger.

5. The basketball shot training apparatus of claim 1, wherein the basketball shot training apparatus is configured to be worn on a hand between the index finger and middle finger, with the web adjoining a saddle between the index finger and middle finger;

with the first arm extending along a portion of the length of the index finger; and with the second arm extending along a portion of the length of the middle finger.

6. The basketball shot training apparatus of claim 1, further comprising:

a second-arm-end ridge that extends from the second arm into the cavity and further extends toward the web substantially parallel to the second arm;

a second-arm-end ridge slot defined by the second-arm-end ridge and a portion of the second arm;

a second-arm-internal ridge that extends from the second arm into the cavity and further extends toward a second arm end substantially parallel to the second arm; and a second-arm-internal ridge slot defined by the second-arm-internal ridge and a portion of the second arm; and wherein the second-arm band coupling slot is at least partially defined by the second-arm-end ridge slot and the second-arm-internal ridge slot.

7. The basketball shot training apparatus of claim 1, wherein the second arm is substantially longer than the first arm.

8. A basketball shot training apparatus comprising:

a first arm extending from a web;

a second arm extending from the web;

a cavity defined by the first and second arm and the web;

a first-arm band disposed on and surrounding a portion of the first arm, and a second-arm band disposed on and surrounding a portion of the second arm;

a first-arm band coupling slot disposed on the first arm facing the cavity; and a second-arm band coupling slot disposed on the second arm and facing the cavity a first-arm-end ridge that extends from the first arm into the cavity and further extends toward the web substantially parallel to the first arm;

a first-arm-end ridge slot defined by the first-arm-end ridge and a portion of the first arm;

a first-arm-internal ridge that extends from the first arm into the cavity and further extends toward a first arm end substantially parallel to the first arm; and a first-arm-internal ridge slot defined by the first-arm-internal ridge and a portion of the first arm;

an accelerometer extending on a distal portion of the first arm from the cavity; and a visual signal system operatively coupled to the accelerometer for providing at least two signals, wherein the first-arm band coupling slot is at least partially defined by the first-arm-end ridge slot and the first-arm-internal ridge slot.

9. The basketball shot training apparatus of claim 8, wherein said visual signal system provides a first signal when the accelerometer detects the basketball shot training apparatus in a first position and provides a second signal when the accelerometer detects the basketball shot training apparatus in a second position.

10. The basketball shot training apparatus of claim 8, wherein the basketball shot training apparatus is configured to be worn on a hand between the index finger and middle finger, with the web adjoining a saddle between the index finger and middle finger;

with the first arm extending along a portion of the length of the index finger;

with the second arm extending along a portion of the length of the middle finger;

with the first elastic band surrounding a portion of the index finger; and with the second elastic band surrounding a portion of the middle finger.

11. The basketball shot training apparatus of claim 8, wherein outer portions of the first and second arm are concave.

12. The basketball shot training apparatus of claim 8, wherein the first and second arm are substantially rigid.

13. The basketball shot training apparatus of claim 8, wherein the second arm is substantially longer than the first arm.

* * * * *